US005882508A

United States Patent [19]

St-Jacques

[11] Patent Number: 5,882,508

[45] Date of Patent: Mar. 16, 1999

[54] EASY CLEAN SYSTEM FOR A GUTTER

[76] Inventor: Jean St-Jacques, 1350 Berkly-Powell Road, Aylmer, Quebec, Canada, J9H 6W5

[21] Appl. No.: 858,356

[22] Filed: May 19, 1997

[51] Int. Cl.[6] ..... B21D 35/02

[52] U.S. Cl. ..... 210/87; 52/12; 52/16; 52/169.5; 210/170; 210/238; 210/248; 210/447; 210/470; 405/43; 405/50

[58] Field of Search ..... 52/12, 16, 169.1, 52/169.5; 210/85, 87, 162, 159, 170, 238, 248, 447, 455, 470; 405/37, 41, 43, 45, 46, 50

[56] References Cited

U.S. PATENT DOCUMENTS

| | | | |
|---|---|---|---|
| 1,653,473 | 12/1927 | Schulz . | |
| 2,887,073 | 5/1959 | Thompson | 108/28 |
| 3,060,952 | 10/1962 | Bystrom | 137/67 |
| 3,465,885 | 9/1969 | Trump | 210/447 |
| 3,628,668 | 12/1971 | Huppert | 210/446 |
| 4,161,186 | 7/1979 | Sitarz | 137/356 |
| 4,460,469 | 7/1984 | Francesconi, Jr. | 210/470 |
| 4,472,274 | 9/1984 | Williams | 210/163 |
| 4,620,817 | 11/1986 | Cushing | 405/45 |
| 5,230,798 | 7/1993 | Rogman | 210/447 |
| 5,452,546 | 9/1995 | Goddard | 210/170 |

*Primary Examiner*—Peter A. Hruskoci
*Attorney, Agent, or Firm*—Michael I. Kroll

[57] ABSTRACT

An easy clean system (18) for a gutter (20) at the eaves (24) of a roof (26) on a building (28) comprising a leader (34) connected to an aperture (36) in the gutter (20), so that the leader (34) will extend vertically down along an exterior wall (38) of the building (28) and carry rainwater away from the roof (26). A facility (40) within the leader (34) is for separating any dirt and debris (30) that falls into the rainwater in the gutter (20), so that the rainwater will flow without obstruction out through the leader (34).

25 Claims, 10 Drawing Sheets

Fig. 7a
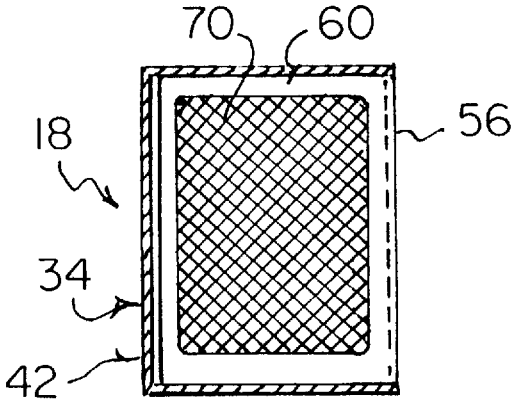
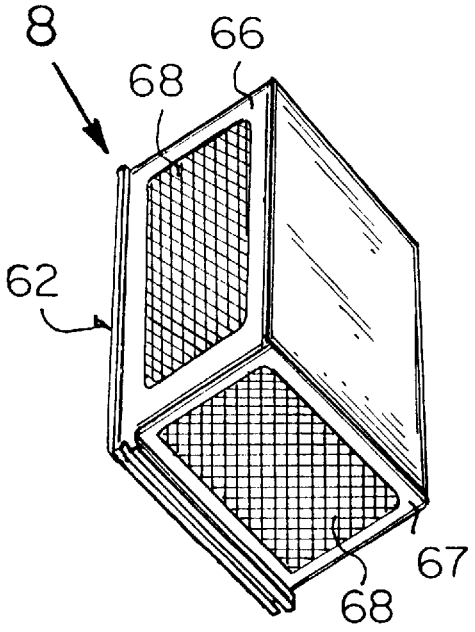
Fig. 7b

Fig. 14
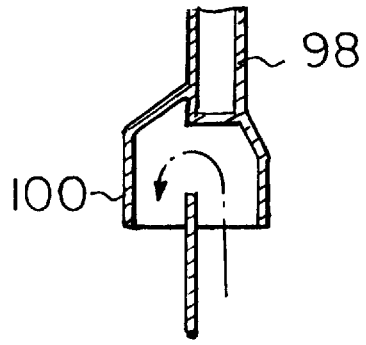
Fig. 15
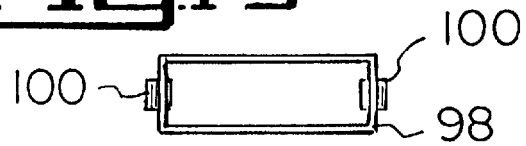
Fig. 13
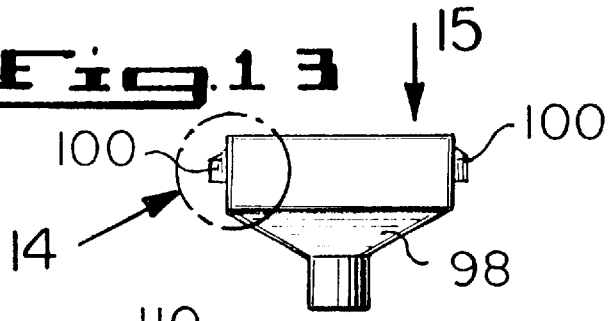
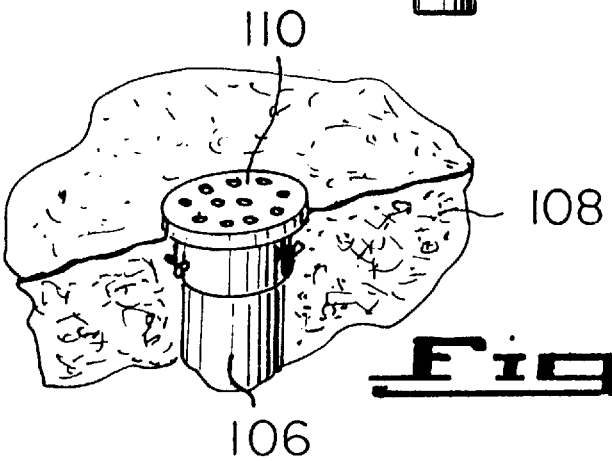
Fig. 16

EASY CLEAN SYSTEM FOR A GUTTER

BACKGROUND OF THE INVENTION

1. Field of the Invention

The instant invention relates generally to drainage devices and more specifically it relates to an easy clean system for a gutter. The easy clean system for a gutter allows dirt and debris to flow without obstruction from a gutter into a leader, so that the water can exit freely therefrom.

2. Description of the Prior Art

Numerous drainage devices have been provided in prior art that are adapted to carry off rainwater or sewage from one location to another. While these units may be suitable for the particular purpose to which they address, they would not be as suitable for the purposes of the present invention as heretofore described.

SUMMARY OF THE INVENTION

A primary object of the present invention is to provide an easy clean system for a gutter that will overcome the shortcomings of the prior art devices.

Another object is to provide an easy clean system for a gutter that will allow dirt and debris to flow without obstruction from a gutter on a roof of a building into a leader, so that the water can exit freely therefrom.

An additional object is to provide an easy clean system for a gutter that will separate the dirt and debris from water with a filter partition, so that a basket that collects the dirt and debris can be removed from the leader, while access to the leader at ground level, will allow a person to clean out the dirt and debris that accumulates therein.

A further object is to provide an easy clean system for a gutter that is simple and easy to use.

A still further object is to provide an easy clean system for a gutter that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 7:
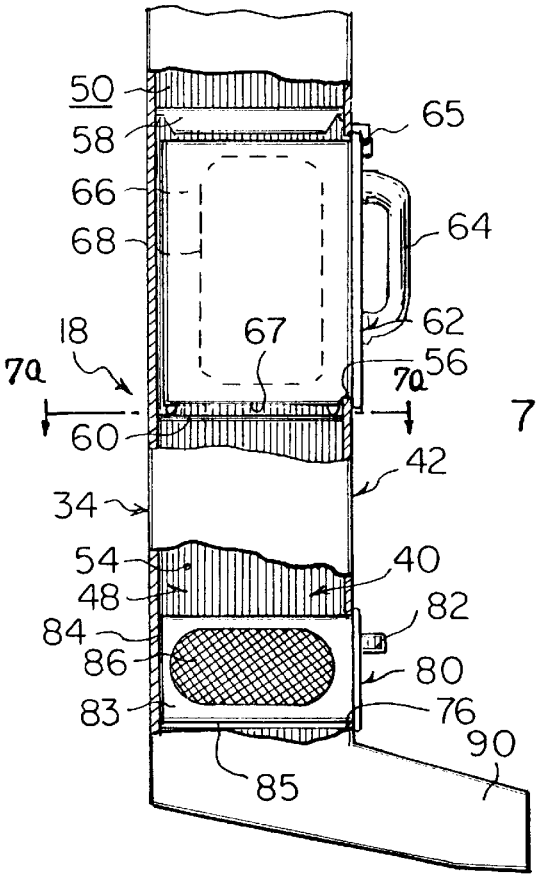
FIG. 7 is a side elevational view taken in the direction of arrow 7 in FIG. 6, with parts broken away and in section.

FIG. 7*a* is a cross sectional view taken along line 7*a*—7*a* in FIG. 7.

FIG. 7*b* is a bottom perspective view of the basket per se.

Figure 3:
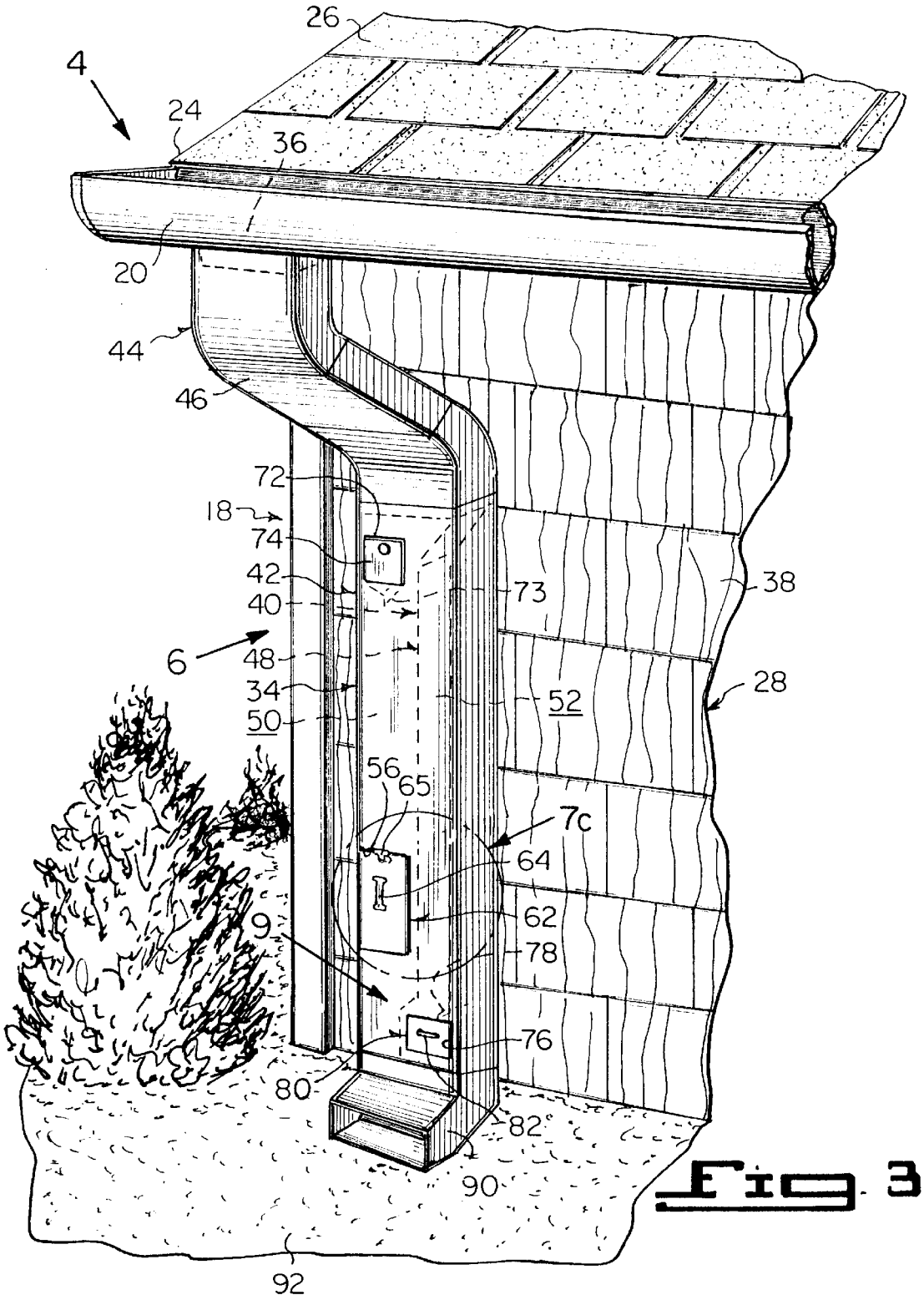
FIG. 3 is a top perspective view of a portion of a building with a first embodiment of the instant invention installed thereto and ready for use.
Figure 4:
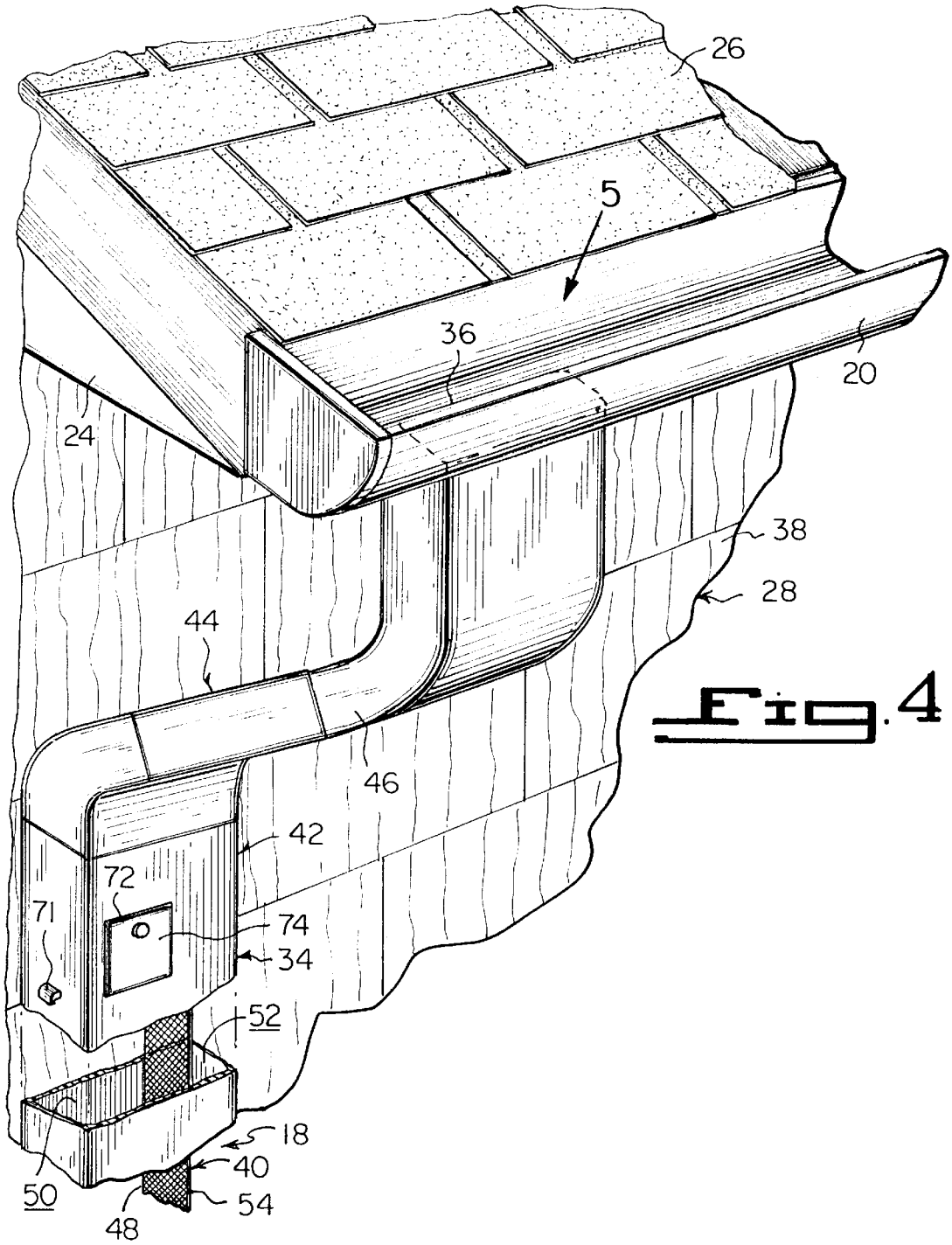
FIG. 4 is a top perspective view taken in the direction of arrow 4 in FIG. 3, with parts broken away and in section.
Figure 5:
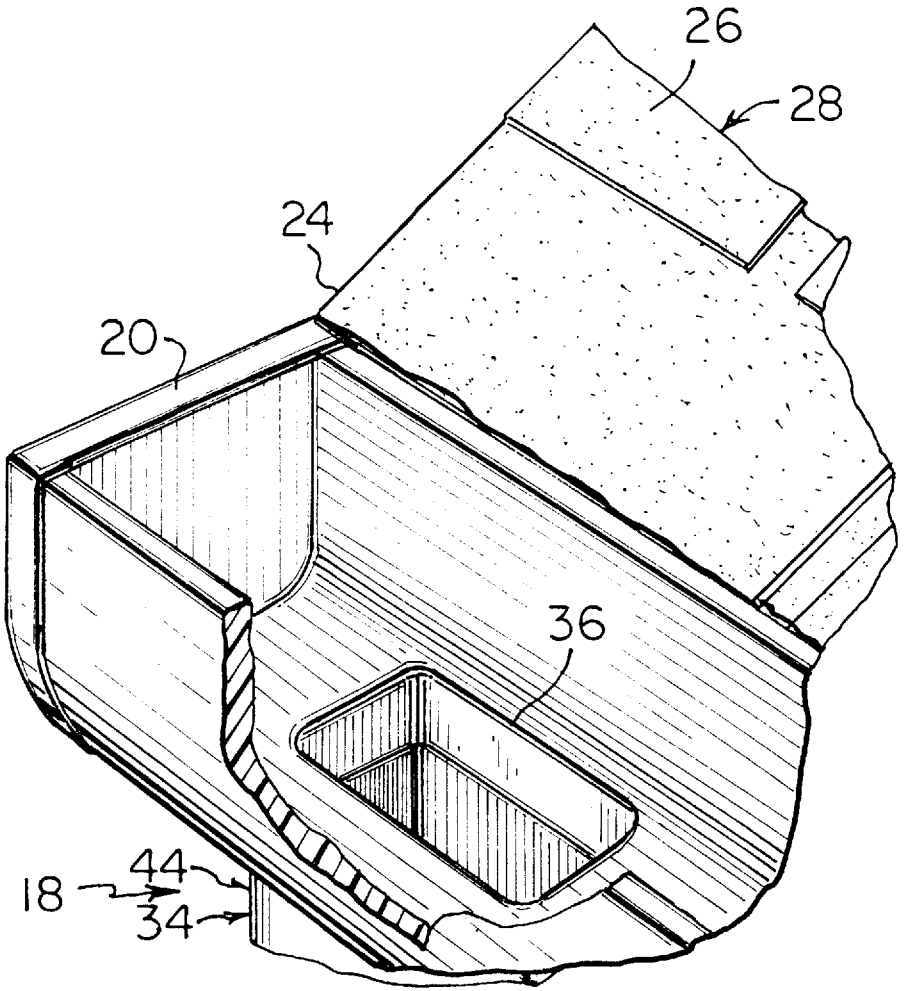
FIG. 5 is a top perspective view taken in the direction of arrow 5 in FIG. 4, with parts broken away and in section.
Figure 7C:
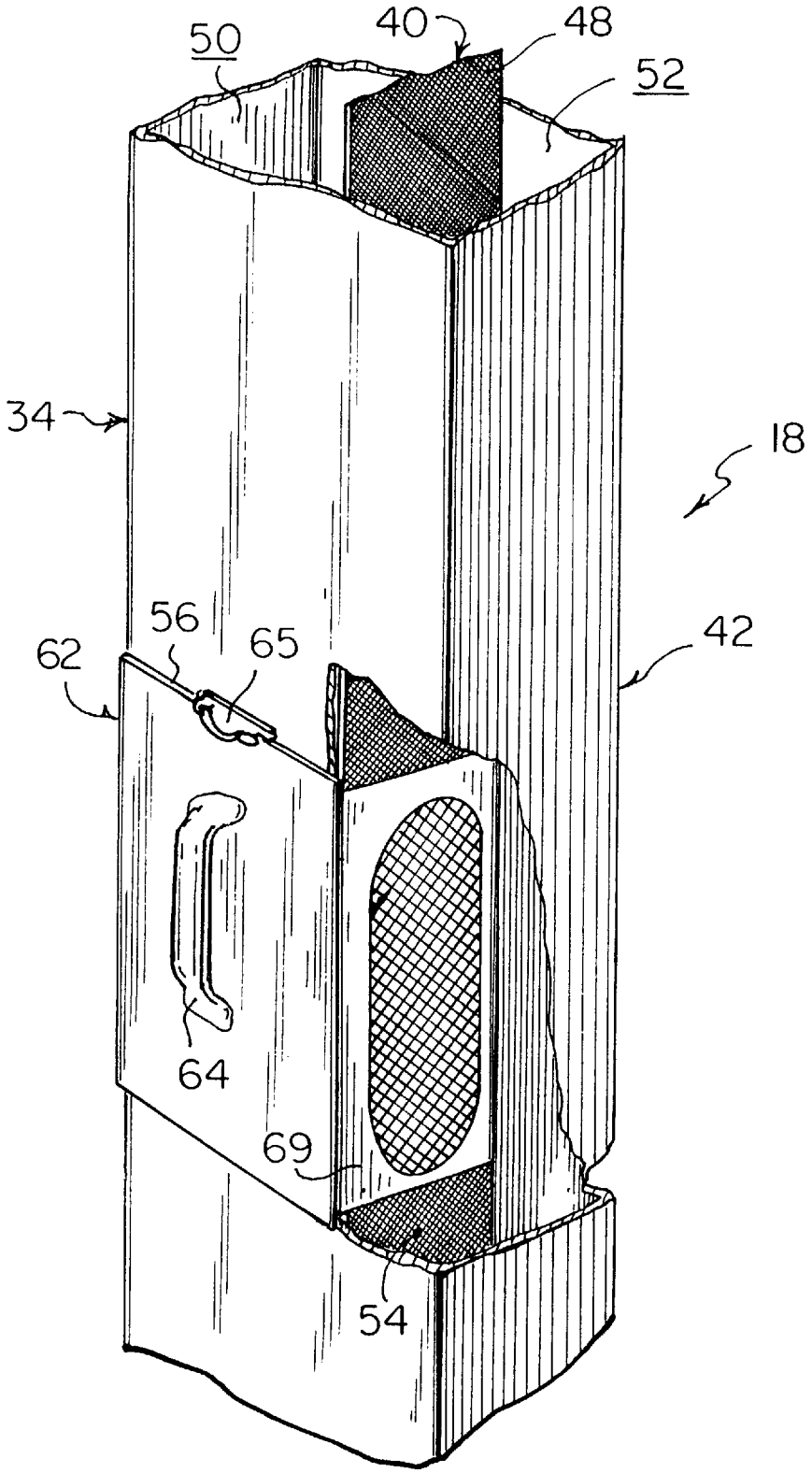

FIG. 7*c* is an enlarged top perspective view of an area as indicated by arrow 7*c* in FIG. 3, with parts broken away and in section.

Figure 8:
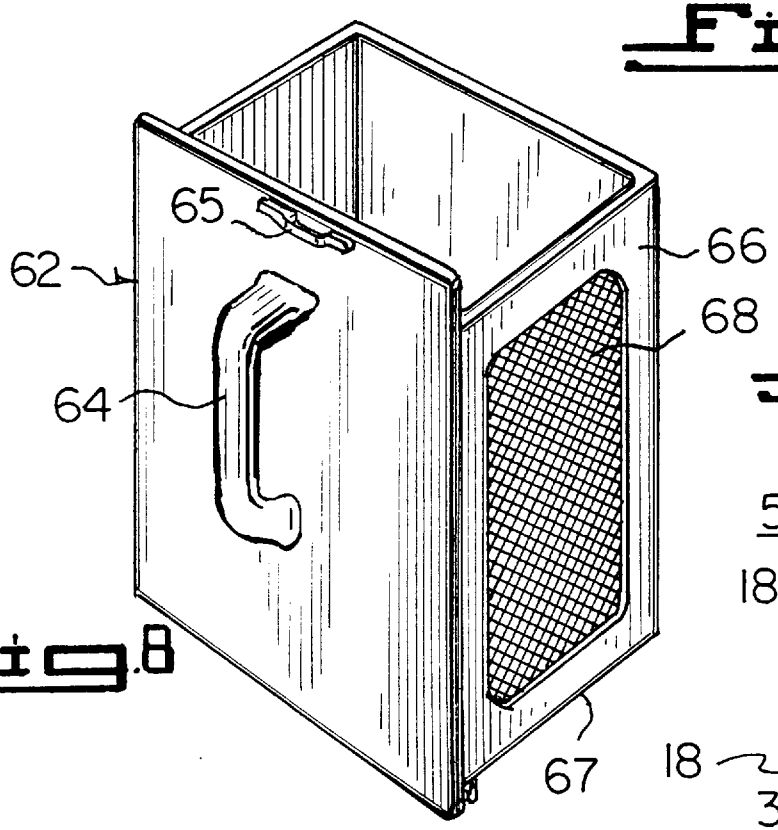

FIG. 8 is a top perspective view of the basket taken in direction of arrow 8 in FIG. 7*b*.

Figure 9:
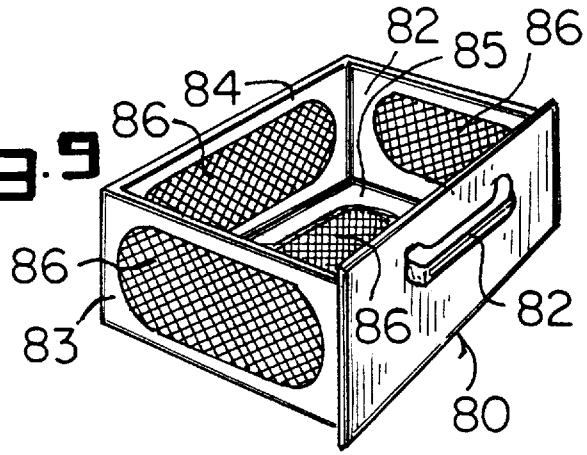

FIG. 9 is a top perspective view of the tray per se.

Figure 6:
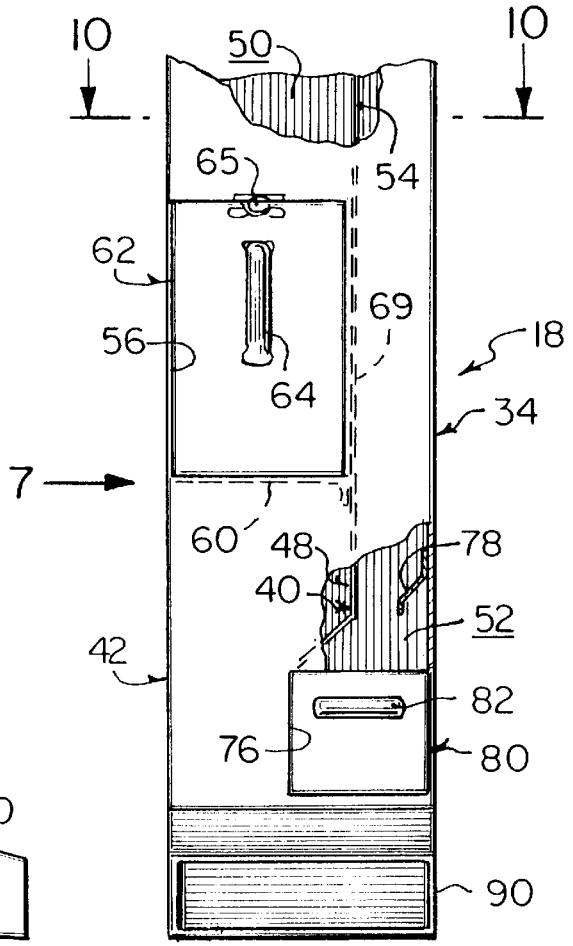
FIG. 6 is a front elevational view taken in the direction of arrow 6 in FIG. 3, with parts broken away and in section.
Figure 10:
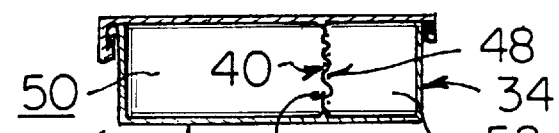

FIG. 10 is a cross sectional view taken along line 10—10 in FIG. 6.

Figure 11:
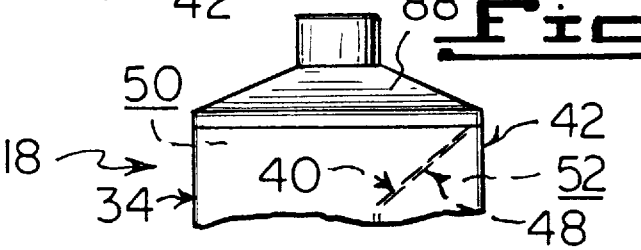

FIG. 11 is a front elevational view with parts broken away, showing a transfer connector in the leader used between the gooseneck and the vertical pipe.

Figure 12:
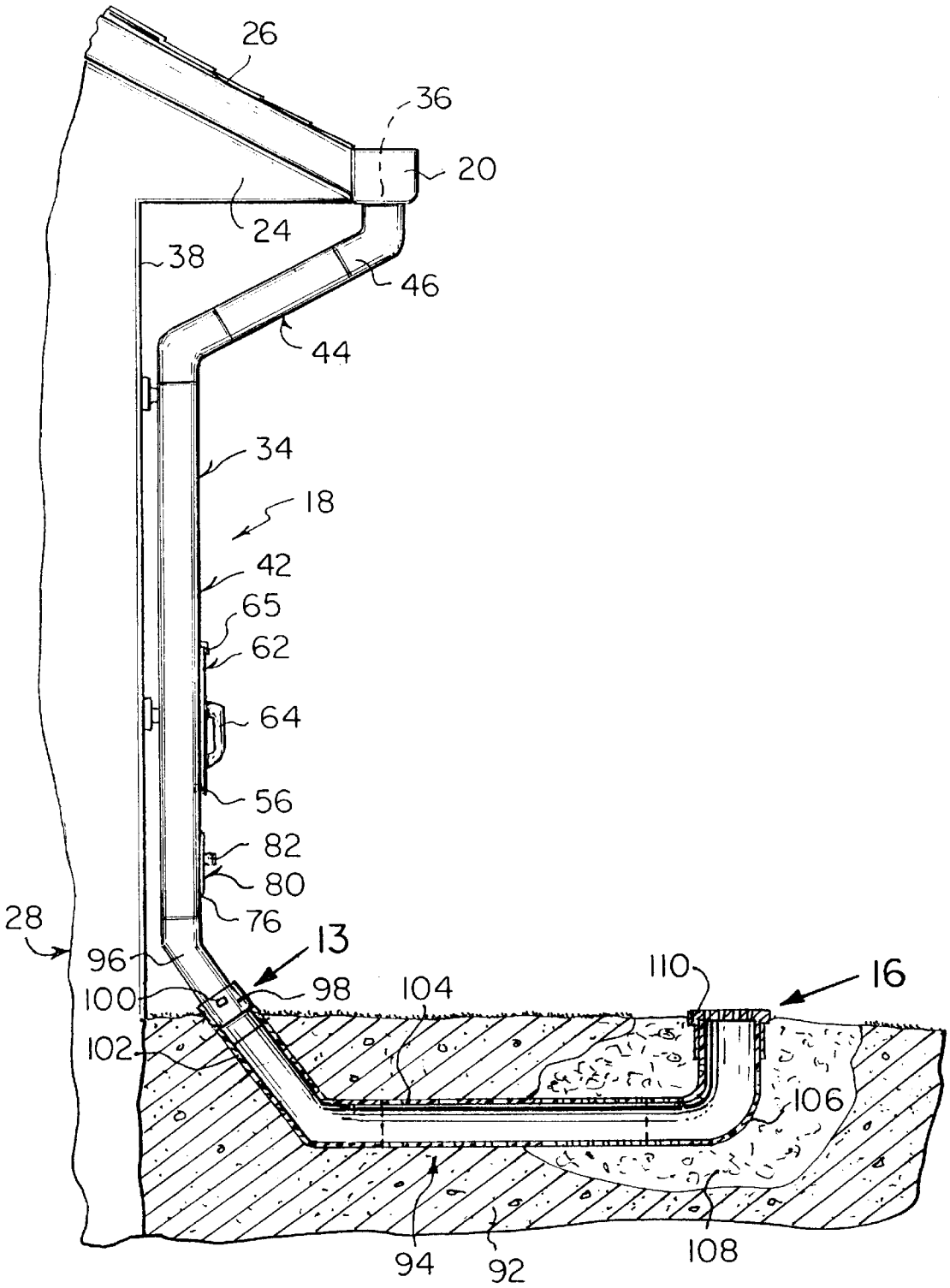

FIG. 12 is a side elevational view of a portion of a building with a second embodiment of the instant invention installed thereto, partly in cross section and ready for use.

FIG. 13 is an elevational view of the reducer per se taken in the direction of arrow 13 in FIG. 12.

FIG. 14 is an enlarged cross sectional view of an area as indicated by arrow 14 in FIG. 13, showing one of the back flow outlets in greater detail.

FIG. 15 is a top view of the reducer taken in the direction of arrow 15 in FIG. 13.

FIG. 16 is a top perspective view taken generally in the direction of arrow 16 in FIG. 12, showing the removable perforated cover in greater detail.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 3 to 16 illustrate an easy clean system 18 for a gutter 20 being the present invention. With regard to the reference numerals used, the following numbering is used throughout the various drawing figures.

18 easy clean system
20 standard gutter
22 standard leader
24 eaves on 26
26 roof of 28
28 building
30 dirt and debris
32 rainstorm
34 leader of 18
36 aperture in 20
38 exterior wall of 28
40 separating facility in 34
42 elongated pipe of 34
44 connecting structure of 34
46 gooseneck joint for 44
48 filter partition for 40
50 first passageway in 34

52 second passageway in 34
54 wire mesh material of 48
56 front aperture into 50 of 34
58 funnel in 50 above 56
60 shelf in 50 below 56
62 basket in 56
64 front handle of 62
65 locking mechanism of 62
66 side wall of 62
67 bottom wall of 62
68 wire mesh window in 66 and 67
69 wire mesh window frame in 48
70 wire mesh window in 60
71 side overflow outlet into 50 of 34
72 front opening into 50 of 34
73 upper side deflector in 50 of 34 below 72
74 front access door at 72
76 front orifice into 52 of 34
78 lower side deflector in 52 of 34 above 76
80 tray in 76
82 front handle of 80
83 side wall of 80
84 rear wall of 80
85 bottom wall of 80
86 wire mesh window in 83, 84 and 85
88 transfer connector between 46 and 42
90 shoe
92 ground
94 underground drainage assembly
96 forty-five degree elbow shoe of 94
98 reducer of 94
100 back flow outlet in 98
102 forty-five degree elbow pipe of 94
104 perforated drainpipe of 94
106 ninety degree perforated elbow pipe of 94
108 crushed stone in 92
110 perforated cover of 94

Figure 1:
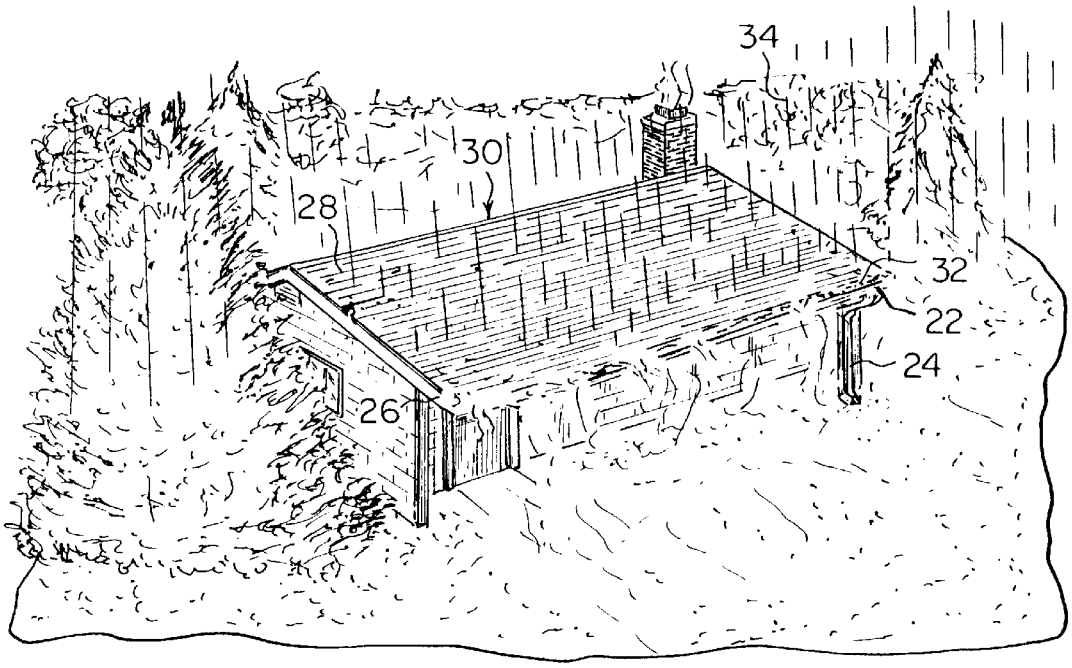
Fig. 1 (PRIOR ART)
FIG. 1 is a top perspective view of the prior art, showing a standard gutter and leader on a building clogged up with dirt and debris during a rain storm.
Figure 2:
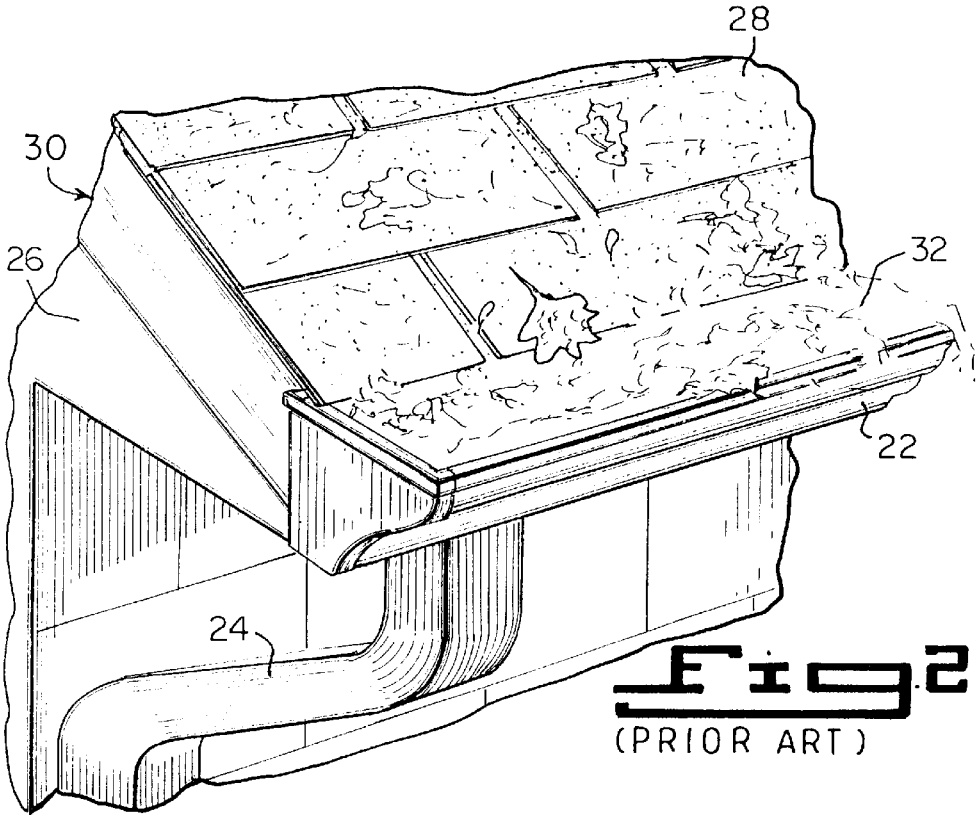
Fig. 2 (PRIOR ART)
FIG. 2 is an enlarged top perspective view of the prior art, showing the dirt and debris in the standard gutter and leader in greater detail.

FIGS. 1 and 2 shows the prior art being a standard gutter 20 and leader 22. The gutter 20 is at an eaves 24 of a roof 26 on a building 28 clogged up with dirt and debris 30 during a rainstorm 32.

The easy clean system 18 consists of a leader 34 connected to an aperture 36 in the gutter 20, so that the leader 34 will extend vertically down along an exterior wall 38 of the building 28 and carry rainwater away from the roof 26. A seperating facility 40 within the leader 34 is for separating any dirt and debris 30 that fall into the rainwater in the gutter 20, so that the rainwater will flow without obstruction out through the leader 34.

The leader 34 includes an elongated pipe 42. A structure 44 is for connecting a top end of the elongated pipe 42 to the aperture 36 in the gutter 20, so that the rainwater can flow out through the aperture 36 in the gutter 20 and into the elongated pipe 42. The connecting structure 44 is a gooseneck joint 46 extending between the aperture 36 in the gutter 20 and the top end of the elongated pipe 42.

The separating facility 40 is a filter partition 48 extending vertically within the leader 34, to divide the leader 34 into two passageways 50 and 52. When the rainwater with the dirt and debris 30 enters the leader 34, the dirt and debris 30 will enter into the first passageway 50 and be collected therein. The rainwater will enter into the second passageway 52 through the filter partition 48 and exit out from a bottom end of the leader 34. The filter partition 48 is fabricated out of a wire mesh material 54, to keep the dirt and debris 30 trapped within the first passageway 50, while allowing the rainwater to pass therethrough and into the second passageway 52.

The leader 34 has a front aperture 56 into the first passageway 50 near the bottom end thereof. A funnel 58 extends across the first passageway 50 directly above the front aperture 56. A shelf 60 extends across the first passageway 50 directly below the front aperture 56. A basket 62 fits in a removable manner into the front aperture 56 and onto the shelf 60 and below the funnel 58, so as to collect the dirt and debris 30 that enters into the first passageway 50. The basket 62 includes a front handle 64 to be gripped by a hand of a person. A locking mechanism 65 retains the basket 62 within the front aperture 56 in the leader 34. A side wall 66 of the basket 62 facing the filter partition 48 and a bottom wall 67 each have a wire mesh window 68, to allow any rainwater entering the basket 62 to exit through the wire mesh windows 68.

The filter partition 48 contains a wire mesh window frame 69 adjacent to the side wall 66 of the basket 62 having the wire mesh window 68. The shelf 60 includes a wire mesh window 70 adjacent to the bottom wall 67 of the basket 62 having the wire mesh window 68.

The leader 34 has a side overflow outlet 71 and a front opening 72 into the first passageway 50 near the top end thereof. An upper side deflector 73 is mounted within the leader 34 in the first passageway 50 below the front opening 72. A front access door 74 is at the front opening 72. When there is a buildup of dirt and debris 30 in the first passageway 50, the rainwater will flow out of the overflow outlet 71 as a warning. The front access door 74 can be opened to allow a hose to be inserted through the front opening 72, to flush out the dirt and debris 30 therefrom.

The leader 34 also has a front orifice 76 into the second passageway 52 at the bottom end thereof. A lower side deflector 78 is mounted within the leader 34 in the second passageway 52 above the front orifice 76. A tray 80 fits in a removable manner into the front orifice 76 and below the lower side deflector 78, so as to trap any fine particles of dirt and debris 30 that may enter into the second passageway 52.

The tray 80 includes a front handle 82 to be gripped by a hand of a person. Side walls 83, rear wall 84 and bottom wall 85 of the tray 80 each have a wire mesh window 86, to allow any rainwater entering the tray 80 to exit through the wire mesh windows 86.

A transfer connector 88, as shown in FIG. 11, can be used between a bottom end of the gooseneck joint 46 and a top end of the elongated pipe 42, if the gooseneck joint 46 and the elongated pipe 42 are of different geometric shapes. A shoe 90, as shown in FIGS. 3, 6 and 7, can be affixed to a bottom end of the elongated pipe 42, so that the rainwater exiting therefrom can splash upon the ground 92.

An underground drainage assembly 94, as best seen in FIG. 12, can be affixed to a bottom end of the elongated pipe 42, so that the rainwater exiting therefrom can be deposited into the ground 92. The underground drainage assembly 94 consists of a forty-five degree elbow shoe 96 affixed to the bottom end of the elongated pipe 42. A reducer 98 that has at least one back flow outlet 100 is connected at a first end to the forty-five degree elbow shoe 96. A forty-five degree perforated elbow pipe 102 is affixed at a first end to a second end of the reducer 98, wherein the forty-five degree perforated elbow pipe 102 extends into the ground 92. A perforated drainpipe 104 is affixed at a first end to a second end of the forty-five degree perforated elbow pipe 102 in the ground 92. A ninety degree perforated elbow pipe 106 is affixed at a first end to a second end of the perforated drainpipe 104 within crushed stone 108 in the ground 92. The second end of the ninety degree perforated elbow pipe 106 extends to a top surface of the crushed stone 108. A perforated cover 110 is attached in a removable manner to the second end of the ninety degree perforated elbow pipe 106 at the top surface of the crushed stone 108, so that the rainwater exiting therefrom can be deposited into the crushed stone 108 in the ground 92.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An easy clean system for a gutter at the eaves of a roof on a building comprising:

a) a leader connected to an aperture in the gutter, so that said leader will extend vertically down along an exterior wall of the building and carry rainwater away from the roof;

b) means within said leader for separating any dirt and debris that falls into the rainwater in the gutter, so that the rainwater will flow without obstruction out through said leader, said separating means being a filter partition extending vertically within said leader to divide said leader into two passageways, so that when the rainwater with the dirt and debris enters said leader the dirt and debris will enter into said first passageway and be collected therein, while the rainwater will enter into said second passageway through said filter partition and exit out from a bottom end of said leader, said leader having a front aperture into said first passageway near the bottom end thereof;

c) a funnel extending across said first passageway directly above said front aperture;

d) a shelf extending across said first passageway directly below said front aperture; and e) a basket which fits in a removable manner into said front aperture and onto said shelf and below said funnel, so as to collect the dirt and debris that enters into said first passageway.

2. An easy clean system for a gutter as recited in claim 1, wherein said leader includes:

a) an elongated pipe; and b) means for connecting a top end of said elongated pipe to the aperture in the gutter, so that the rainwater can flow out through the aperture in the gutter and into said elongated pipe.

3. An easy clean system for a gutter as recited in claim 2, wherein said connecting means is a gooseneck joint extending between the aperture in the gutter and the top end of said elongated pipe.

4. An easy clean system for a gutter as recited in claim 3, further includes a transfer connector used between a bottom end of said gooseneck joint and a top end of said elongated pipe if said gooseneck joint and said elongated pipe are of different geometric shapes.

5. An easy clean system for a gutter as recited in claim 3, wherein said filter partition is fabricated out of a wire mesh material to keep the dirt and debris trapped within said first passageway, while allowing the rainwater to pass therethrough and into said second passageway.

6. An easy clean system for a gutter as recited in claim 5, wherein said basket includes:

a) a front handle to be gripped by a hand of a person;

b) a locking mechanism to retain said basket within said front aperture in said leader; and c) a side wall of said basket facing said filter partition and a bottom wall, each having a wire mesh window to allow any rainwater entering said basket to exit through said wire mesh windows.

7. An easy clean system for a gutter as recited in claim 6, wherein said filter partition includes a wire mesh window frame adjacent to said side wall of said basket having said wire mesh window.

8. An easy clean system for a gutter as recited in claim 7, wherein said shelf includes a wire mesh window adjacent to said bottom wall of said basket having said wire mesh window.

9. An easy clean system for a gutter as recited 8, further including:

a) said leader having a side overflow outlet and a front opening into said first passageway near the top end thereof;

b) an upper side deflector mounted within said leader in said first passageway below said front opening; and c) a front access door at said front opening, so that when there is a buildup of dirt and debris in said first passageway, the rainwater will flow out of said overflow outlet as a warning, whereby said front access door can be opened to allow a hose to be inserted through said front opening to flush out the dirt and debris therefrom.

10. An easy clean system for a gutter as recited in claim 9, further including:

a) said leader having a front orifice into said second passageway at the bottom end thereof;

b) a lower side deflector mounted within said leader in said second passageway above said front orifice; and c) a tray which fits in a removable manner into said front orifice and below said lower side deflector, so as to trap any fine particles of dirt and debris that may enter into said second passageway.

11. An easy clean system for a gutter as recited 10, wherein said tray includes:

a) a front handle to be gripped by a hand of a person; and b) side walls, rear wall and bottom wall of said each having a wire mesh window to allow any rainwater entering said tray to exit through said wire mesh windows.

12. An easy clean system for a gutter as recited in claim 11, further includes a transfer connector used between a bottom end of said gooseneck joint and a top end of said elongated pipe if said gooseneck joint and said elongated pipe are of different geometric shapes.

13. An easy clean system for a gutter as recited in claim 11, further including a shoe affixed to a bottom end of said elongated pipe, so that the rainwater exiting therefrom can splash upon the ground.

14. An easy clean system for a gutter as recited in claim 11, further including an underground drainage assembly affixed to a bottom end of said elongated pipe, so that the rainwater exiting therefrom can be deposited into the ground.

15. An easy clean system for a gutter as recited in claim 14, wherein said underground drainage assembly includes:

a) a forty-five degree elbow shoe affixed to the bottom end of said elongated pipe;

b) a reducer having at least one back flow outlet is connected at a first end to said forty-five degree elbow shoe;

c) a forty-five degree perforated elbow pipe affixed at a first end to a second end of said reducer, wherein said forty-five degree perforated elbow pipe extends into the ground;

d) a perforated drainpipe affixed at a first end to a second end of said forty-five degree perforated elbow pipe in the ground;

e) a ninety degree perforated elbow pipe affixed at a first end to a second end of said perforated drainpipe within crushed stone in the ground, whereby the second end of said ninety degree perforated elbow pipe extends to a top surface of the crushed stone; and f) a perforated cover attached in a removable manner to the second end of said ninety degree perforated elbow pipe at the top surface of the crushed stone, so that the rainwater exiting therefrom can be deposited into the crushed stone in the ground.

16. An easy clean system for a gutter as recited in claim 2, further including a shoe affixed to a bottom end of said elongated pipe, so that the rainwater exiting therefrom can splash upon the ground.

17. An easy clean system for a gutter as recited in claim 2, further including an underground drainage assembly affixed to a bottom end of said elongated pipe, so that the rainwater exiting therefrom can be deposited into the ground.

18. An easy clean system for a gutter as recited in claim 17, wherein said underground drainage assembly includes:

a) a forty-five degree elbow shoe affixed to the bottom end of said elongated pipe;

b) a reducer having at least one back flow outlet is connected at a first end to said forty-five degree elbow shoe;

c) a forty-five degree perforated elbow pipe affixed at a first end to a second end of said reducer, wherein said forty-five degree perforated elbow pipe extends into the ground;

d) a perforated drainpipe affixed at a first end to a second end of said forty-five degree perforated elbow pipe in the ground;

e) a ninety degree perforated elbow pipe affixed at a first end to a second end of said perforated drainpipe within crushed stone in the ground, whereby the second end of said ninety degree perforated elbow pipe extends to a top surface of the crushed stone; and f) a perforated cover attached in a removable manner to the second end of said ninety degree perforated elbow pipe at the top surface of the crushed stone, so that the rainwater exiting therefrom can be deposited into the crushed stone in the ground.

19. An easy clean system for a gutter as recited in claim 1, wherein said filter partition is fabricated out of a wire mesh material to keep the dirt and debris trapped within said first passageway, while allowing the rainwater to pass therethrough and into said second passageway.

20. An easy clean system for a gutter as recited in claim 1, wherein said basket includes:

a) a front handle to be gripped by a hand of a person;

b) a locking mechanism to retain said basket within said front aperture in said leader; and c) a side wall of said basket facing said filter partition and a bottom wall each having a wire mesh window to allow any rainwater entering said basket to exit through said wire mesh windows.

21. An easy clean system for a gutter as recited in claim 20, wherein said filter partition includes a wire mesh window frame adjacent to said side wall of said basket having said wire mesh window.

22. An easy clean system for a gutter as recited in claim 20, wherein said shelf includes a wire mesh window adjacent to said bottom wall of said basket having said wire mesh window.

23. An easy clean system for a gutter as recited 1, further including:

a) said leader having a side overflow outlet and a front opening into said first passageway near the top end thereof;

b) an upper side deflector mounted within said leader in said first passageway below said front openings; and c) a front access door at said front opening, so that when there is a buildup of dirt and debris in said first passageway, the rainwater will flow out of said overflow outlet as a warning, whereby said front access door can be opened to allow a hose to be inserted through said front opening to flush out the dirt and debris therefrom.

24. An easy clean system for a gutter as recited in claim 1, further including:

a) said leader having a front orifice into said second passageway at the bottom end thereof;

b) a lower side deflector mounted within said leader in said second passageway above said front orifice; and c) a tray which fits in a removable manner into said front orifice and below said lower side deflector, so as to trap any fine particles of dirt and debris that may enter into said second passageway.

25. An easy clean system for a gutter as recited 11, wherein said tray includes:

a) a front handle to be gripped by a hand of a person; and b) side walls, rear wall and bottom wall of said tray each having a wire mesh window to allow any rainwater entering said tray to exit through said wire mesh windows.

* * * * *